US009707146B2

(12) United States Patent
Kwon

(10) Patent No.: US 9,707,146 B2
(45) Date of Patent: Jul. 18, 2017

(54) WEARABLE ROBOT AND METHOD FOR CONTROLLING THE SAME

(71) Applicant: Samsung Electronics Co., Ltd., Suwon-Si, Gyeonggi-Do (KR)

(72) Inventor: Sunggu Kwon, Yongin-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 10 days.

(21) Appl. No.: 14/558,288

(22) Filed: Dec. 2, 2014

(65) Prior Publication Data

US 2015/0224013 A1 Aug. 13, 2015

(30) Foreign Application Priority Data

Feb. 11, 2014 (KR) ..... 10-2014-0015687

(51) Int. Cl.
*A63B 22/00* (2006.01)
*A61H 1/02* (2006.01)

(52) U.S. Cl.
CPC ... *A61H 1/0262* (2013.01); *A61H 2201/5064* (2013.01)

(58) Field of Classification Search
USPC ..... 482/1–148; 601/23–30
See application file for complete search history.

(56) References Cited

U.S. PATENT DOCUMENTS 7,190,141 B1 * 3/2007 Ashrafiuon ..... B25J 9/0006 318/568.12
7,544,155 B2 * 6/2009 Agrawal ..... B25J 9/0006 482/69
8,500,823 B2 * 8/2013 Herr ..... A61F 2/64 623/24
8,674,838 B2 * 3/2014 Konishi ..... A61H 3/00 340/539.12
8,684,890 B2 * 4/2014 Bosecker ..... A61H 1/005 482/54
8,801,641 B2 * 8/2014 Kazerooni ..... A61H 3/008 128/898
8,864,846 B2 * 10/2014 Herr ..... A61F 2/66 623/25
8,945,028 B2 * 2/2015 Kazerooni ..... A61H 3/00 601/23
8,986,233 B2 * 3/2015 Aoki ..... A61H 1/024 601/34
9,104,207 B2 * 8/2015 Kim ..... B62D 57/032
9,216,131 B2 * 12/2015 Nakashima ..... A61H 3/00
(Continued)

FOREIGN PATENT DOCUMENTS

JP 2010104397 A 5/2010
JP 2013111408 A 6/2013
KR 1020130029620 A 3/2013

*Primary Examiner* — Stephen Crow

(74) *Attorney, Agent, or Firm* — Harness, Dickey & Pierce, P.L.C.

(57) ABSTRACT

A wearable robot includes a mechanism unit for assisting an wearer of the wearable robot in walking motion; a detection unit equipped on the wearer's body for detecting a moving direction of an arm of the wearer; and a controller for determining a walking intent of the wearer based on the moving direction of the arm of the wearer detected by the detection unit, and controlling the mechanism unit to produce auxiliary torque corresponding to the determined walking intent.

17 Claims, 9 Drawing Sheets

(56) References Cited

U.S. PATENT DOCUMENTS 9,224,096 B2 * 12/2015 Oppenheimer ..... G06F 21/50
2008/0000317 A1 * 1/2008 Patton ..... A61F 5/0102 74/500.5
2008/0310579 A1 12/2008 Boezaart
2009/0192619 A1 * 7/2009 Martin ..... A61F 2/60 623/18.11
2010/0121232 A1 * 5/2010 Sankai ..... A61H 3/008 601/23
2011/0205067 A1 * 8/2011 Konishi ..... A61H 3/008 340/573.1
2012/0071797 A1 3/2012 Aoki et al.
2013/0218295 A1 * 8/2013 Holgate ..... A61F 2/60 623/25
2013/0231711 A1 * 9/2013 Kaib ..... G06F 19/3418 607/5
2014/0058299 A1 * 2/2014 Sankai ..... A61B 5/112 601/35
2014/0094345 A1 * 4/2014 Kim ..... A63B 21/4009 482/7
2014/0200680 A1 * 7/2014 Holgate ..... A61F 2/60 623/24
2014/0296761 A1 * 10/2014 Yamamoto ..... A61H 1/0244 602/23
2014/0343460 A1 * 11/2014 Evans, III ..... A61B 5/112 600/595
2015/0012111 A1 * 1/2015 Contreras-Vidal .. A61B 5/4851 623/25
2015/0051710 A1 * 2/2015 Herr ..... A61F 2/66 623/27
2015/0058263 A1 * 2/2015 Landers ..... G06F 19/3475 706/11
2015/0134080 A1 * 5/2015 Roh ..... B25J 9/0006 623/32
2015/0150706 A1 * 6/2015 Patton ..... A61F 5/0102 602/16
2015/0182784 A1 * 7/2015 Barriskill ..... A61N 1/36003 607/3
2015/0321340 A1 * 11/2015 Smith ..... B25J 9/10 74/490.01

* cited by examiner

WEARABLE ROBOT AND METHOD FOR CONTROLLING THE SAME

CROSS-REFERENCE TO RELATED APPLICATION(S)

This application claims the benefit under 35 U.S.C. §119 (a) of a Korean patent application filed on Feb. 11, 2014 in the Korean Intellectual Property Office and assigned Serial No. 10-2014-0015687, the entire disclosure of which is incorporated hereby incorporated by reference.

TECHNICAL FIELD

Example embodiments relate to a wearable robot and method for controlling the wearable robot. For example, at least some example embodiments relate to a wearable robot that assists in walking based on the intent of the wearer and method for controlling the same.

BACKGROUND

Multi-purpose wearable robots may assist the disabled, weak, and old in their physical strength to move, rehabilitate muscle disease patients, carry heavy kits for soldiers, or hoist heavy loads in an industrial field.

For example, the wearable robot for assisting in physical strength may include one or more of an upper limb assist robot for moving upper limbs and lower limb assist robot for moving lower limbs. Among them, the lower limb assist robot is worn on the lower body of the wearer, applying auxiliary torque to joints of e.g., hip and knee of the wearer to reduce physical load of the wearer. Such a wearable robot for assisting in physical strength of lower limbs may assist the wearer in making various motions in their daily life, such as walking on the flat or tilting ground, climbing up or down the stairs and sitting down or standing up, etc.

SUMMARY

Example embodiments relate to a wearable robot and method for controlling the same in order to properly assist in walking by determining an intent of the wearer.

In some example embodiments, the wearable robot may include a mechanism unit for assisting an wearer of the wearable robot in walking motion; a detection unit equipped on the wearer's body for detecting a moving direction of an arm of the wearer; and a controller for determining a walking intent of the wearer based on the moving direction of the arm of the wearer detected by the detection unit, and controlling the mechanism unit to produce auxiliary torque corresponding to the determined walking intent.

In other example embodiments, the method for controlling a wearable robot may include detecting an arm motion of a wearer of the wearable robot; determining a moving direction of the wearer's arm based on the arm motion; determining a walking intent of the wearer based on the moving direction of the wearer's arm; and producing auxiliary torque corresponding to the walking intent.

Other aspects, advantages, and salient features of the disclosure will become apparent to those skilled in the art from the following detailed description, which, taken in conjunction with the annexed drawings, discloses example embodiments.

BRIEF DESCRIPTION OF THE DRAWINGS

The above and other features and advantages of the example embodiments will become more apparent by describing in detail some of the example embodiments thereof with reference to the attached drawings in which.

Throughout the drawings, like reference numerals will be understood to refer to like parts, components, and structures.

DETAILED DESCRIPTION

Figure 1:
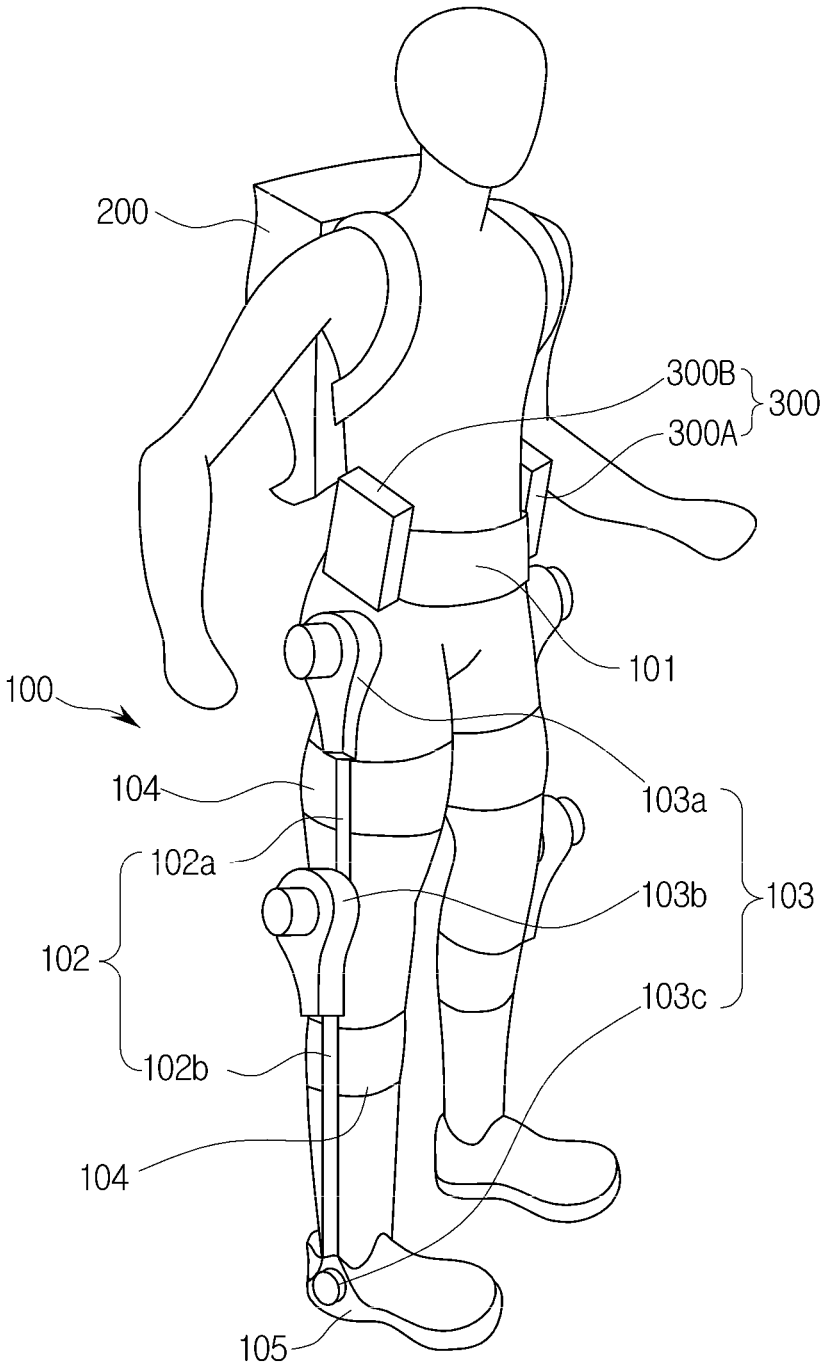
FIG. 1 illustrates a person who wears a wearable robot according to some example embodiments.

Example embodiments will now be described more fully with reference to the accompanying drawings, in which some example embodiments are shown. The example embodiments may, however, be embodied in many different forms and should not be construed as being limited to the example embodiments set forth herein; rather, these example embodiments are provided so that this disclosure will be thorough and complete, and will fully convey the concept of the example embodiments to those skilled in the art. Like reference numerals in the drawings denote like elements, and thus their description will be omitted. In the description of the example embodiments, if it is determined that a detailed description of commonly-used technologies or structures related to the example embodiments may unnecessarily obscure the subject matter of the example embodiments, the detailed description will be omitted. It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section.

Example embodiments will now be described more fully with reference to the accompanying drawings, in which some example embodiments are shown. In the drawings, the thicknesses of layers and regions are exaggerated for clarity. Like reference numerals in the drawings denote like elements.

Detailed illustrative embodiments are disclosed herein. However, specific structural and functional details disclosed herein are merely representative for purposes of describing example embodiments. Example embodiments may be embodied in many alternate forms and should not be construed as limited to only those set forth herein.

It should be understood, however, that there is no intent to limit this disclosure to the particular example embodiments disclosed. On the contrary, example embodiments are to cover all modifications, equivalents, and alternatives falling within the scope of the example embodiments. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of this disclosure. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Various example embodiments will now be described more fully with reference to the accompanying drawings in which some example embodiments are shown. In the drawings, the thicknesses of layers and regions are exaggerated for clarity.

Example embodiments of a wearable robot and method for controlling the same will now be described in detailed with reference to accompanying drawings. Although in the following example embodiments, a lower limb assist robot in particular will be described as an example of a wearable robot, the example embodiments are not limited to the lower limb assist robot but may be applied to any wearable robot that is able to assist in physical strength of the wearer.

FIG. 1 illustrates a person who wears a wearable robot according to some example embodiments.

Referring to FIG. 1, a wearable robot may include a mechanism unit 100, a controller 200, and a detection unit 300.

The mechanism unit 100 may be a walking assistance device for assisting the wearer in walking, including components, such as joints and motors for walking motion, actuators like fluid power cylinders, and belts for combining with legs. The mechanism unit 100 may assist the wearer in walking by means of the joints and actuators.

For example, the mechanism unit 100 may include a waist-wear unit 101, a supporting unit 102, a joint unit 103, and a fastening unit 104, as shown in FIG. 1. The waist-wear unit 101 may be worn on the waist of the wearer. The waist-wear unit 101 may be deformable, but not exclusively, depending on the shape and size of the waist. Accordingly, the waist-wear unit 101 may securely support the waist based on the body shape without forcing to deform the waist.

Although not specifically shown in FIG. 1, the waist-wear unit 101 may include a waist support (not shown) for securely supporting the waist of the wearer and a band (not shown) to wrap the belly part of the wearer. Therefore, the waist-wear unit 101 may reduce the burden of weight applied to the waist of the wearer by wrapping the belly and the back of the wearer.

The supporting unit 102 may serve to assist the wearer in walking. The supporting unit 102 may include a first support frame 102*a* and a second support frame 102*b* each having a certain length, as shown in FIG. 1. The first and second frames 102*a* and 102*b* may each have a bar type on a plate, but example embodiments are not limited thereto.

The first support frame 102*a* may be located above the knee of the wearer, with one end connected to the waist-wear unit 101 and the other end connected to the second support frame 102*b*. The second support frame 102*b* may be located under the knee of the wearer, with one end connected to the first support frame 102*a* and the other end connected to a shoe unit 105.

A joining part of the one end of the first support frame 102*a* and the waist-wear unit 101, and a joining part of the other end of the first support frame 102*a* and one end of the second support frame 102*b*, and a joining part of the other end of the second frame 102*b* and the shoe part 105 may be each rotatable, but example embodiments are not limited thereto.

Furthermore, each of the joining parts may have, but not exclusively, at least 1 degree of freedom (DOF). The DOF refers to a degree of freedom in forward kinematics or inverse kinematics. The DOF of a machine refers to the number of independent motions of the machine, or the number of variables that determines independent motions at relative positions between respective links. For example, an object in a three dimensional (3D) space represented by x-axis, y-axis, and z-axis has one or more of 3 DOF (respective positions on the three axes) to determine a spatial position of the object and 3 DOF (respective rotation angles against the three axes) to determine a spatial orientation of the object. Specifically, provided that an object may be able to move along each axis and rotate around each axis, the object may be said to have 6 DOF.

The first support frame 102*a* and the second support frame 102*b* may be each adjustable to a length according to the length of the leg of the wearer.

The joint unit 103 may include, but not exclusively, a first joint 103*a*, a second joint 103*b*, and a third joint 103*c*.

The first joint 103*a* may be formed on the joining part of the one end of the first support frame 102*a* and the waist-wear unit 101 to enable bending of a corresponding joint of the wearer between the hip and the thigh; the second joint 103*b* may be formed on the joining part of the other end of the first support frame 102*a* and the one end of the second support frame 102*b* to serve to enable bending of a knee of the wearer; and the third joint 103*c* may be formed on the other end of the second support frame 102*b* and the shoe part 105 to serve to enable bending of an ankle of the wearer.

As discussed in more detail below with regard to FIG. 2, the first joint 103*a*, second joint 103*b*, and third joint 103*c* may each have a driving unit 110.

The driving units 110 may be configured to deliver driving power to the respective first joint 103*a*, second joint

103*b*, and the third joint 103*c* for rotation. The driving units 110 may include, for example, a pair of gears (not shown) included in a respective joining part and a driving motor (not shown) connected to a shaft of one gear of the pair of gears and driven according to an electrical signal from the controller 200. However, the driving unit 110 is not limited thereto, for example, the driving unit 110 may instead have a ball, fluid power cylinder, etc.

With the driving power delivered from the driving units 110, the first support frame 102*a* and second support frame 102*b* may move around the waist, knee, and ankle of the wearer, and thus bend the joints between the hip and thigh, the knee, and the ankle of the wearer.

Furthermore, although not shown in FIG. 1, respective joint angle measurement sensors for detecting joint angles of the respective joints 103 may be included. The joint angle measurement sensor may include, but not exclusively, an encoder or a potentiometer. The joint angle measurement sensor may be formed on the driving motor of the driving unit 110.

The fastening unit 104 may fasten the respective first support frame 102*a* and second support frame 102*b* to the lower limb of the wearer, and may be implemented with, not exclusively, a band or a belt. As such, by fastening the first support frame 102*a* and second support frame 102*b* to an upper part and lower part of the knee, respectively, the first support frame 102*a* and second support frame 102*b* may securely assist the wearer in their lower limb muscle strength while making motions.

In some example embodiments, the mechanism unit 100 may further include the shoe unit 105. The shoe unit 105 may be configured to cover the foot of the wearer and enable determination of a walking state of the wearer.

Specifically, the shoe unit 105 may be configured to measure the walking state of the wearer while protecting the foot of the wearer by covering the foot. A part on the side of the shoe unit 105 may be rotatably combined with the other end of the second support frame 102*b* as discussed above.

Furthermore, by using e.g., an wire to connect a top part of the shoe unit 105 to the driving motor of the driving unit 110 for the second joint 103*b*, a bending angle of the ankle may depend on an angle changed according to driving of the driving motor.

In addition, although now shown in FIG. 1, a Ground Reaction Force (GRF) measurement sensor may be equipped on the bottom of the shoe unit 105. The GRF measurement sensor is configured to measure a ground reaction force exerted by the ground on the sole of the foot of the wearer. The ground reaction force is the force exerted by the ground on a body, equal in magnitude and opposite in direction to the gravity force or internal force in the body exerted on the ground. That is, it may be understood as the force exerted to the ground when the wearer put his/her foot on the ground.

In some example embodiments, the GRF measurement sensor may include, but not exclusively, a Force Sensing Resistor (FSR), a pressure sensor, etc.

The shoe unit 105 may further include a fastener (not shown). The fastener may allow for one-touch fastening/unfastening, for example, a hook and loop fastener, a snap, etc., on the top to allow the wearer to conveniently take on and off the shoe unit 105.

Furthermore, the mechanism unit 100 may further include a power source (not shown) to supply power. In some example embodiments, a battery may serve as the power source, but example embodiments are not limited thereto.

The detection unit 300 may be configured to detect an arm motion of the wearer.

For example, in some example embodiments, the detection unit 300 may be configured to detect forward or backward motions of one or both arms of the wearer.

Figure 2:
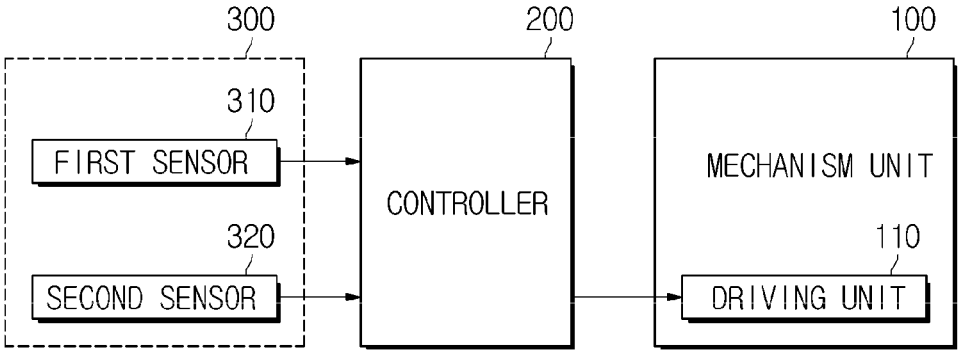
FIG. 2 is a block diagram of a wearable robot, according to some example embodiments.
Figure 3:
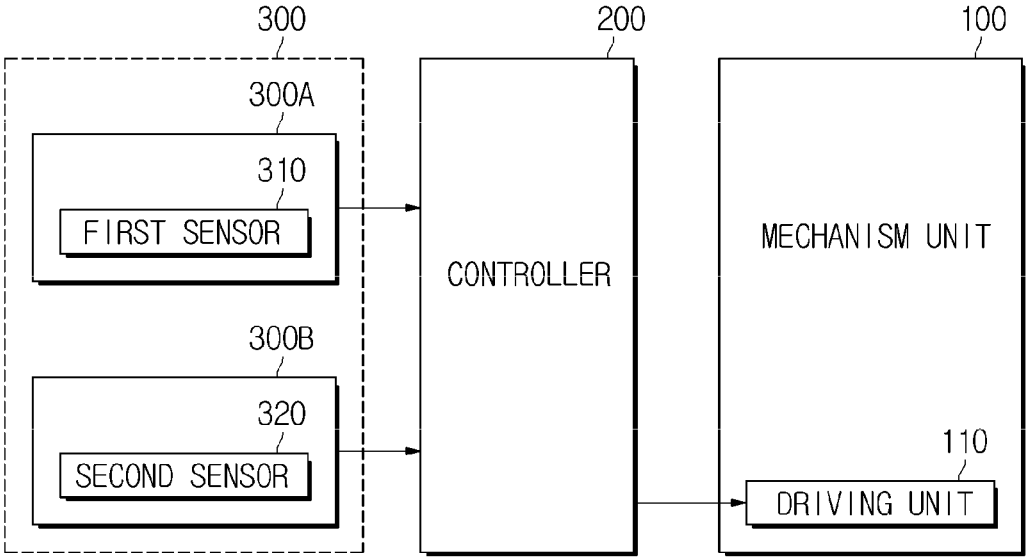
FIG. 3 is a block diagram of a wearable robot, according to some example embodiments.

In some example embodiments, as shown in FIGS. 2 and 3, the detection unit 300 may include, but not exclusively, a first sensor 310 and a second sensor 320. The first and second sensors 310 and 320 may include at least one of proximity sensors, hall sensors, and range sensors, however example embodiments are not limited thereto. If hall sensors are used as the first and second sensors 310 and 320, magnetic substances that produce hall effects may be additionally attached to the arm of the wearer.

In some example embodiments, the detection unit 300 may be attached on the body of the wearer, as shown in FIG. 1. For example, the detection unit 300 may be attached on either side of the body of the wearer to easily detect forward and backward arm motion of the wearer. The side of the body, unlike the front and back of the body, may include e.g., the waist or pelvis rather than the belly or back part. However, the position of the detection unit 300 may not be limited thereto. For example, the detection unit 300 may be attached at any place at which the detection unit 300 may be able to detect forward and backward motions of the wearer's arm.

In the embodiment, the detection unit 300 may be on both sides of the body of the wearer to detect forward or backward motions of both arms of the wearer, or may be on only one side of the body to detect a forward or backward motion of the one arm of the wearer.

In the case the detection unit 300 is on one side of the body of the wearer, the detection unit 300 may include two sensors as shown in FIG. 2, but example embodiments are not limited thereto. For example, in the case the detection unit 300 is equipped on both sides of the body of the wearer, the detection unit 300 may include a first detector 300A equipped on the left side of the body and a second detector 300B equipped on the right side of the body as shown in FIG. 3, but example embodiments are not limited thereto. The first detector 300A and second detector 300B may each include, but not exclusively, only one sensor.

If the detection unit 300 is located on one side of the body of the wearer and detects a moving direction of one arm, the other arm's moving direction may be estimated based on the detected moving direction of the one arm.

A wearer may perform a walking motion by moving the legs forward alternately, with the arms moving in opposite direction of the legs. For example, when the left leg of the wearer moves forward, the left arm of the wearer may move backward, and when the right leg of the wearer moves forward, the left arm of the wearer may move forward. Likewise, when the right leg of the wearer moves forward, the right arm of the wearer may move backward, and when the left leg of the wearer moves forward, the right arm of the wearer may move forward.

In sum, during a natural stride, the wearer may walk with his/her left leg and right arm moving in one direction and his/her right leg and left arm moving in the other direction. Accordingly, in some example embodiments, the wearable robot is configured to detect a moving direction of an arm of the wearer, and estimate a moving direction of the other arm. An associated method will be discussed in more detail later.

Mechanical parts of a wearable robot has thus far been described. Configurations of the wearable robot will now be described.

FIG. 2 is a block diagram of a wearable robot, according to some example embodiments, and FIG. 3 is a block diagram of a wearable robot, according to other example embodiments.

The wearable robot may have the detection unit 300 equipped on one side of the body of the wearer as illustrated in FIG. 2 or the wearable robot may have the detection unit 300 equipped on both sides of the body of the wearer as illustrated in FIG. 3.

Referring to FIG. 2, the wearable robot may include the mechanism unit 100, the controller 200, and the detection unit 100.

The detection unit 300 may be configured to detect an arm motion of the wearer, as described above. The detected arm motion may be a direction of the motion of the arm, i.e., whether the wearer's arm is moving forward or backward.

As shown in FIG. 2, the detection unit 300 may include the first sensor 310 and the second sensor 320, but the number of sensors is not limited thereto. As each of the first and second sensors 310 and 320, a proximity sensors, a hall sensor, and a range sensor may be used, but example embodiments are not limited thereto. If hall sensors are used as the first and second sensors 310 and 320, magnetic substances (not shown) that produce hall effects recognized by the hall sensors may be additionally prepared around the arm of the wearer.

As discussed above, the detection unit 300 may be equipped on the body of the wearer, for example, on a side of the body, but example embodiments are not limited thereto. The detection unit 300 may be equipped on the waist or pelvis of the side of the body. However the position of the detection unit 300 is not limited thereto but may be any place of the body at which the detection unit 300 may be able to detect the arm motion of the wearer.

Furthermore, in some example embodiments, the detection unit 300 may be equipped only one side of the body of the wearer.

Figure 4:
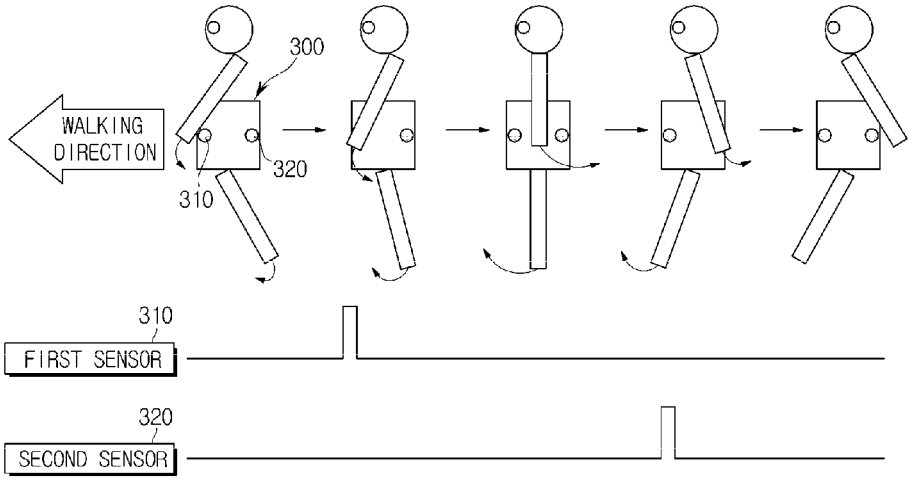
FIG. 4 is a conceptual diagram of detecting a wearer's arm moving backward.
Figure 5:
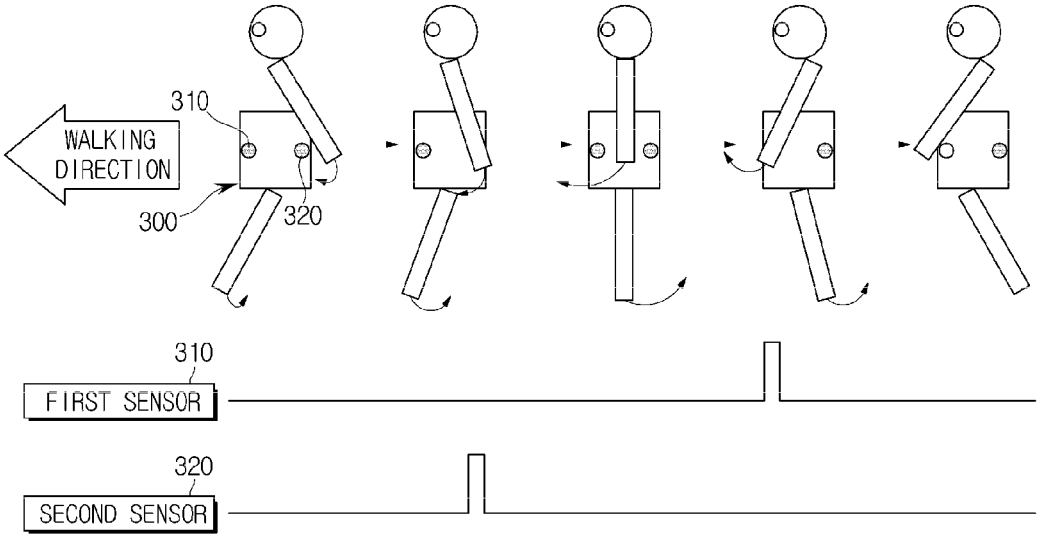
FIG. 5 is a conceptual diagram of detecting a wearer's arm moving forward.

FIGS. 4 and 5 illustrate occasions where the detection unit 300 equipped on one side of the wearer detects forward and backward motions of an arm of the wearer.

As shown in FIGS. 4 and 5, the detection unit 300 is equipped on one side of the body of the wearer, with the first sensor 310 and second sensor 320 arranged some distance apart. For example, the first sensor 310 may be arranged near the front side of the body of the wearer while the second sensor 310 may be arranged near the back side of the body of the wearer, but the arrangement of the sensors is not limited thereto. Such arrangement of sensors may facilitate determination of a moment when the wearer's arm moves forward or backward. This will be described in more detail as follows.

As shown in FIG. 4, when the wearer moves his/her left leg forward, his/her left arm may move backward. At that moment, first, the first sensor 310 arranged near the front of the body may detect the left arm moving backward, and next, the second sensor 320 arranged near the back of the body may detect the left arm moving backward.

When the first sensor 310 is arranged near the front of the body while the second sensor 320 is arranged near the back of the body, if a signal is detected by the first sensor 310 first and then detected by the second sensor 320 next, the controller 200 may determine that the arm is moving backward. Likewise, if a signal is detected by the second sensor 310 first and then detected by the first sensor 310 next, the controller 200 may determine that the arm is moving forward. Details of this determination by the controller 200 as will be discussed later in detail.

Alternatively, as illustrated in FIG. 3, in some example embodiments, the detection unit 300 may be equipped on both sides of the body of the wearer. The detection unit 300 may include the first detector 300A equipped on the left side of the body of the wearer to detect a left arm motion, and the second detector 300B equipped on the right side of the body of the wearer to detect a right arm movement, but example embodiments are not limited thereto.

The first detector 300A and second detector 300B may each include, but not exclusively, only one sensor, i.e., the first sensor 310 and second sensor 320, respectively.

Figure 7:
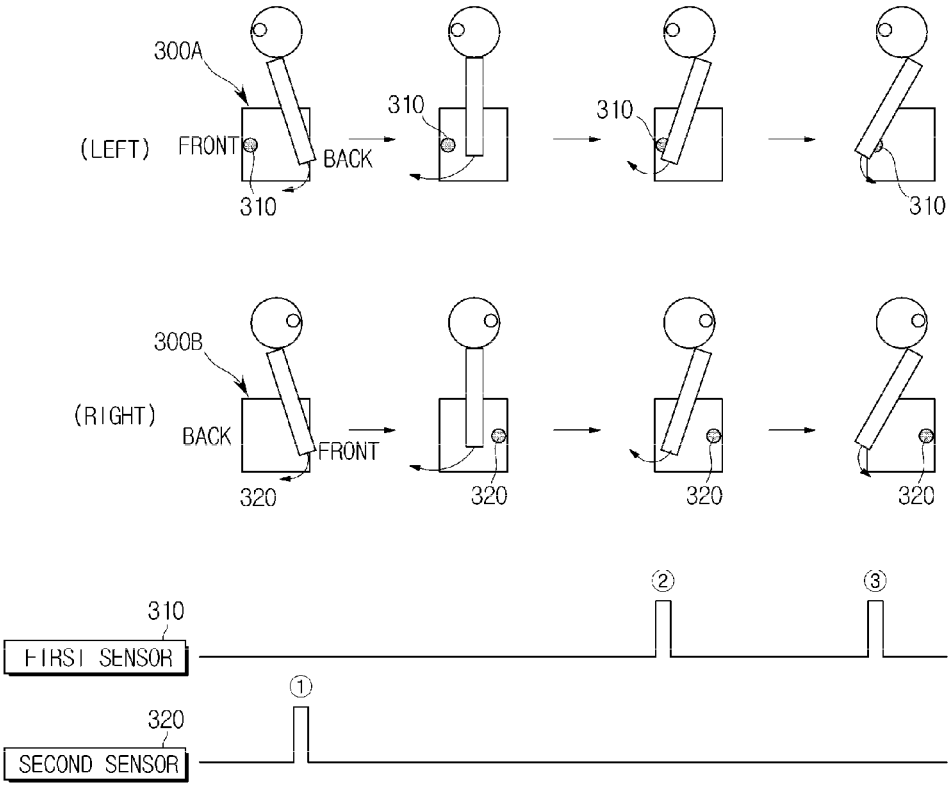
FIG. 7 is a conceptual diagram of detecting whether either of the arms of a wearer are moving forward or backward.
Figure 8:
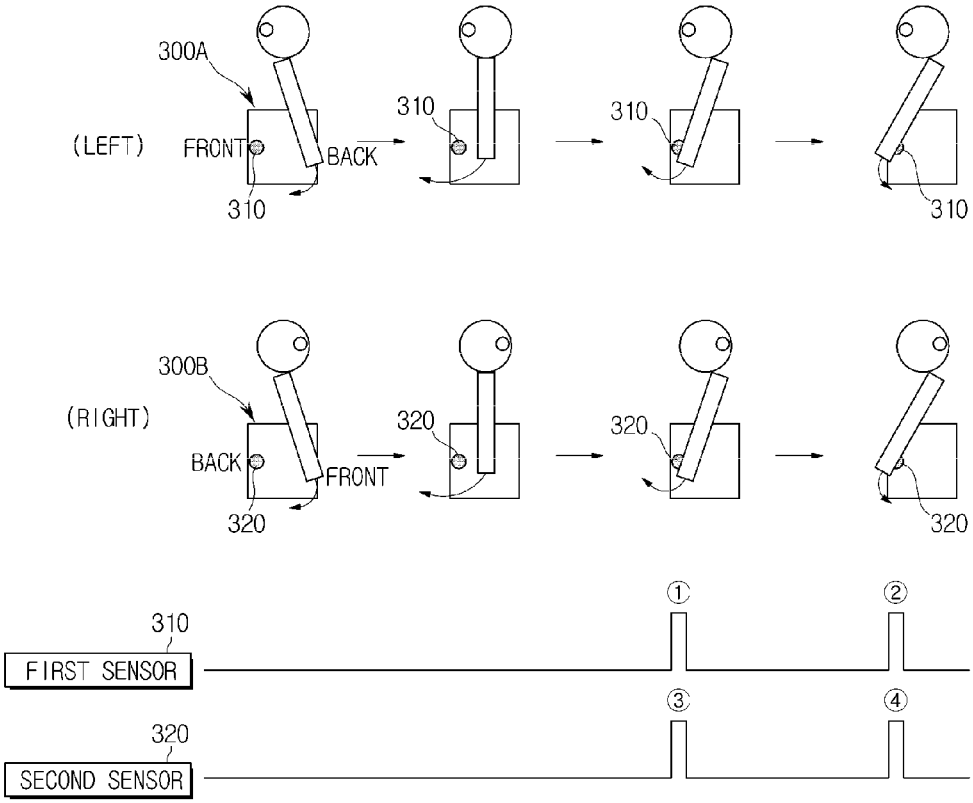
FIG. 8 is another conceptual diagram of detecting whether either of the arms of a wearer are moving forward or backward.

The first sensor 310 included in the first detector 300A and the second sensor 320 included in the second detector 300B may be arranged symmetrically as shown in FIG. 7, or may be arranged diagonally as shown in FIG. 8.

For example, as shown in FIG. 7, the first sensor 310 and second sensor 320 may be symmetrically arranged near the front of the body of the wearer, detecting the left arm and right arm moving forward, respectively. Although the first and second sensors 310 and 320 are both arranged near the front of the body of the wearer in the embodiment of FIG. 7, example embodiments not limited thereto. For example, the sensors 310 and 320 may be arranged near the back of the body of the wearer to detect the left and right arms moving backward, respectively.

Furthermore, as shown in FIG. 8, the first sensor 310 and second sensor 320 may be arranged diagonally such that the first sensor 310 is near the front and the second sensor 320 is near the back of the body of the wearer, such that the first sensor 310 and the second sensor 320 detect the left arm and right arm moving backward, respectively.

The controller 200 is configured to control overall operations of the wearable robot.

The controller 200 may include a processor and a memory (not shown).

Figure 9:
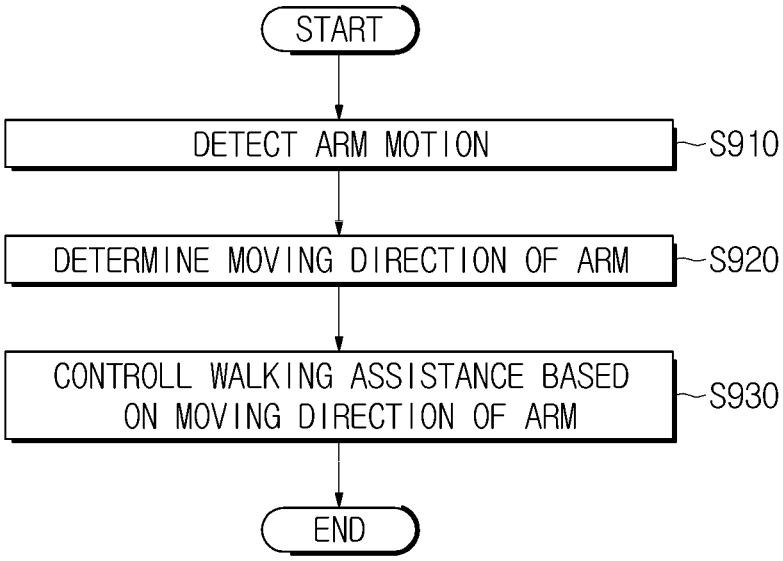
FIG. 9 is a flowchart of a method for controlling a wearable robot, some example embodiments.

The processor may be an arithmetic logic unit, a digital signal processor, a microcomputer, a field programmable array, a programmable logic unit, a microprocessor or any other device capable of responding to and executing instructions in a defined manner such that the processor is programmed with instructions that configure the controller 200 as a special purpose computer to perform the operations illustrated in FIG. 9, such that the processor is configured to determine a walking intent of the wearer based on the wearer's arm motion detected by the detection unit 300, generate a control signal to output auxiliary torque corresponding to the determined walking intent, and send the control signal to the mechanism unit 100. As discussed above, the arm motion may refer to a moving direction of the arm, i.e., forward or backward motion of the arm.

The memory may be a non-volatile memory, a volatile memory, a hard disk, an optical disk, and a combination of two or more of the above-mentioned devices. The memory may be a non-transitory computer readable medium. The non-transitory computer-readable media may also be a distributed network, so that the program instructions are stored and executed in a distributed fashion. The non-volatile memory may be a Read Only Memory (ROM), a Programmable Read Only Memory (PROM), an Erasable Programmable Read Only Memory (EPROM), or a flash memory. The volatile memory may be a Random Access Memory (RAM).

Walking motion is typically done by moving the legs forward alternately, with the arms naturally moving in opposite direction of the corresponding legs. For example, when the left leg moves forward, the left arm moves backward; when the right leg moves forward, the left arm moves forward; when the right leg moves forward, the right arm moves backward; and when the left leg moves forward, the right arm moves forward.

Overall, the natural walking motion is done by moving the "right arm and left leg" in one direction while moving the "left arm and right leg" in the other direction. Furthermore, arm motions get faster in fast walking and get slower in slow walking. It may be understood that the arm motions getting faster and slower means arm motion intervals between moving forward and backward get shorter and longer, respectively.

Accordingly, in some example embodiments, the controller 200 may determine whether the wearer's right or left arm is moving forward or backward based on a signal detected by the detection unit 300, and control the mechanism unit 100 to produce auxiliary torque necessary to move a corresponding leg forward. The controller 200 may also control walking speed based on the right or left arm motion intervals. This will be described in more detail as follows.

Referring to FIGS. 4 and 5, a method for controlling assistance in walking by detecting arm motions of the wearer by means of the detection unit 300 equipped on a side of the body of the wearer and determining a walking intent of the wearer will be described first.

Although in the embodiments of FIGS. 4 and 5, the detection unit 300 is equipped on the left side of the body of the wearer, example embodiments are not limited thereto. For example, the detection unit 300 may be equipped on the right side of the body of the wearer in some other embodiments.

As shown in FIG. 4, while the wearer is walking in the direction of the arrow head, the first sensor 310 may detect the left arm moving backward. Subsequently the second sensor 320 may also detect the left arm moving backwards.

Furthermore, as shown in FIG. 5, the second sensor 320 may detect the left arm moving forward after passing the climax in the back. Subsequently the first sensor 310 may also detect the left arm moving forward. In addition, as shown in FIG. 4, the first sensor 310 may again detect the left arm moving backward after passing the climax in the front.

Figure 6:
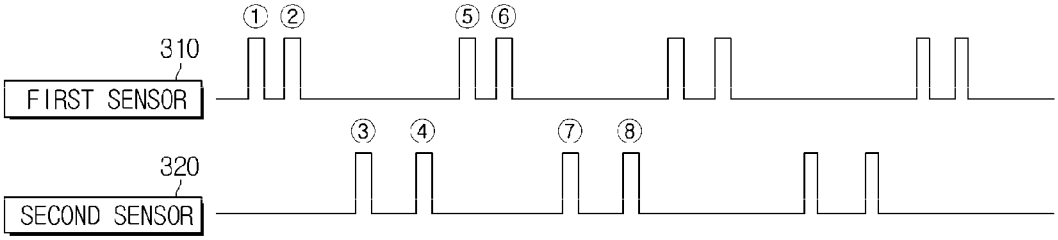
FIG. 6 illustrates signals resulting from detection of a wearer's one arm moving forward and backward by means of first and second sensors.

FIG. 6 illustrates signals resulting from detection of a wearer's one arm moving forward and backward by means of first and second sensors.

Referring to FIG. 6, the results of the detection of the wearer's left arm moving forward and backward repeatedly are illustrated in FIG. 6.

Signal ① of the first sensor 310 may correspond to a result of detection of the left arm moving forward after passing the center of the wearer's body; signal ② of the first sensor 310 may correspond to a result of detection of the left arm moving backward after passing the climax in front of the wearer's body; signal ③ may correspond to a result of detection of the left arm moving backward after passing the center of the wearer's body; and signal ④ may correspond to a result of detection of the left arm moving forward after passing the climax in the back of the wearer's body.

Likewise, signal ⑤ of the first sensor 310 may correspond to a result of detection of the left arm moving forward after passing the center of the wearer's body; signal ⑥ of the first sensor 310 may correspond to a result of detection of the left arm moving backward after passing the climax in front of the wearer's body; signal ⑦ may correspond to a result of detection of the left arm moving backward after passing the center of the wearer's body; and signal ⑧ may correspond to a result of detection of the left arm moving forward again after passing the climax in the back of the wearer's body.

The controller 300 may detect a moving period as a time from a moment at which signal ① is detected to a moment at which signal ⑤ is detected, time from a moment at which signal ② is detected to a moment at which signal ⑥ is detected, time from a moment at which signal ③ is detected to a moment at which signal ⑦ is detected, and/or a time from a moment at which signal ④ is detected to a moment at which signal ⑧ is detected.

Accordingly, if signals are detected in sequence by the first sensor 310 and then by the second sensor 320 (②→③), the controller 200 may determine that the wearer's left arm is moving backward; if signals are detected in sequence by the second sensor 320 and then again by the second sensor 320 (③→④ or ⑦→⑧), the controller 200 may determine that the wearer's left arm is moving forward again after passing the climax in the back; if signals are detected in sequence by the second sensor 320 and then by the first sensor 310 (④→⑤), the controller 200 may determine that the wearer's left arm is moving forward; and if signals are detected in sequence by the first sensor 310 and then by the first sensor 310 (①→② or ⑤→⑥), the controller 200 may determine that the wearer's left arm is moving backward again after passing the climax in the front.

In the meantime, in the case the detection unit 300 is equipped on one side of the wearer's body, the controller 200 may estimate a moving direction of one arm based on a detected moving direction of the other arm. In other words, as shown in FIGS. 4 and 5 where the detection unit 300 is equipped on the left side of the wearer's body, a moving direction of the left arm may be detected by means of the detection unit 300 and a moving direction of the right arm may be estimated based on the detected moving direction of the left arm. On the other hand, where the detection unit 300 is equipped on the right side of the wearer's body, a moving direction of the right arm may be detected by means of the detection unit 300 and a moving direction of the left arm may be estimated based on the detected moving direction of the right arm.

For example, if signals are detected in sequence by the first sensor 310 and then by the second sensor 320, the controller 200 may determine that the wearer's left arm is moving backward and accordingly estimate that the wearer's right arm is moving forward. If signals are detected in sequence by the second sensor 320 and then by the second sensor 320, the controller 200 may determine that the wearer's left arm is moving forward after passing the climax in the back and accordingly estimate that the wearer's right arm is moving backward after passing the climax in the front.

The controller 200 may determine whether the respective arms of the wearer are moving forward or backward, and control the mechanism unit 100 to produce auxiliary torque necessary to support one leg opposite of an arm moving backward while moving forward the other leg opposite of the other arm moving forward.

For example, if the controller 200 determines that the wearer's left arm is moving forward and the right arm is moving backward, the controller 200 may send a control signal to produce auxiliary torque necessary to move the wearer's right leg forward while supporting the left leg. Likewise, if the controller 200 determined that the wearer's right arm is moving forward while the left arm is moving backward, the controller 200 may send a control signal to produce auxiliary torque necessary to move the wearer's left leg forward while supporting the right leg.

Furthermore, referring to FIGS. 3, 7 and 8, a method for controlling assistance in walking by detecting arm motions of the wearer by means of the detection unit 300 equipped on both sides of the body of the wearer and determining a walking intent of the wearer will be described. As described above, where the detection unit 300 may be equipped on both sides of the wearer's body, the detection unit 300 may include the first detector 300A equipped on the left side of the wearer's body for detecting the left arm motion of the wearer, and the second detector 300B equipped on the right side of the wearer's body for detecting the right arm motion of the wearer.

The first detector 300A and second detector 300B may include the first sensor 310 and second sensor 320, respectively. The first sensor 310 may be used to detect the left arm of the wearer and the second sensor 320 may be used to detect the right arm of the wearer.

The first sensor 310 and second sensor 320 may be arranged symmetrically as illustrated in FIG. 7, or, the first sensor and the second sensor 320 may be arranged diagonally as illustrated in FIG. 8, however example embodiments are not limited thereto.

For example, as shown in FIG. 7, the first sensor 310 and second sensor 320 may be symmetrically arranged close to each other on the front part of the side of the wearer's body. While the sensors are both arranged on the front part of the side of the wearer's body in the embodiment of FIG. 7, they may be arranged symmetrically on the back of the wearer's body in other example embodiments.

Furthermore, as shown in FIG. 8, the first sensor 310 and second sensor 320 may be diagonally arranged, the first sensor being arranged at a position near the front part of the side of the wearer's body and the second sensor 320 being arranged at a position near the back part of the side of the wearer's body. Although the first sensor 310 is arranged at a position near the front of the wearer's body and the second sensor 320 is arranged at position near the back of the wearer's body in the example embodiment of FIG. 8, it may be possible, on the contrary, that the first sensor 310 is arranged at a position near the back of the wearer's body and the second sensor 320 is arranged at a position near the front of the wearer's body.

As described above, forward and backward motions of the wearer's left and right arms may be detected by means of the first sensor 310 and second sensor 320 equipped on the left and right sides, respectively, of the wearer's body.

For example, referring to FIG. 7, signal ① of the second sensor 320 may correspond to a result of detection of the wearer's right arm moving backward after passing the climax in front of the wearer's body; signal ② of the first sensor 310 may correspond to a result of detection of the left arm moving forward after passing the center of the wearer's body; and signal ③ may correspond to a result of detection of the left arm moving backward after passing the climax in front of the wearer's body.

Accordingly, as shown in FIG. 7 where the first sensor 310 and second sensor 320 are equipped on both sides of the wearer's body symmetrically, if signals are detected in sequence by the second sensor 320 and then by the first sensor 310 (①→②), the controller 200 may determine that the wearer's left arm is moving forward and the right arm is moving backward; if signals are detected in sequence by the first sensor 310 and then again by first sensor 310 (②→③), the controller 200 may determine that the wearer's left arm is moving backward after passing the climax in the front and the right arm is moving forward after passing the climax in the back; if signals are detected in sequence by the first sensor 310 and then by the second sensor 320, the controller 200 may determine that the wearer's left arm is moving backward and the right arm is moving forward; and if signals are detected in sequence by the second sensor 320 and then again by second sensor 320, the controller 200 may determine that the wearer's right arm is moving backward after passing the climax in the front and the left arm is moving forward after passing the climax in the back.

Furthermore, referring to FIG. 8, signal ① of the first sensor 310 may correspond to a result of detection of the left arm moving forward after passing the center on the side of the wearer's body; signal ② of the first sensor 310 may correspond to a result of detection of the left arm moving backward after passing the climax in front of the wearer's body; signal ③ may correspond to a result of detection of the right arm moving backward after passing the center on the side of the wearer's body; and signal ④ may correspond to a result of detection of the right arm moving forward after passing the climax in the back of the wearer's body.

While in FIG. 8 signals ① and ③, and signals ② and ④ are illustrated as being detected at the same time, it will be appreciated that in other example embodiments each of the signals may be detected at different points in time. In other words, detection points of signals ① and ② may precede or follow those of signals ③ and ④, respectively.

As shown in FIG. 8 where the first sensor 310 and the second sensor 320 are equipped diagonally on both sides of the wearer's body, if signals are detected by the first and second sensors 310 and 320, the controller 200 may determine that the wearer's left arm is moving forward and the right arm is moving backward.

With the detection mechanism, the controller 200 may determine whether the respective arms of the wearer are moving forward or backward, and control the mechanism unit 100 to produce auxiliary torque necessary to support one leg opposite of an arm moving backward while moving forward the other leg opposite of the other arm moving forward.

For example, if the controller 200 determines that the wearer's left arm is moving forward and the right arm is moving backward, the controller 200 may send a control signal to produce auxiliary torque necessary to move the wearer's right leg forward while supporting the left leg; and otherwise, if the controller 200 determines that the wearer's right arm is moving forward while the left arm is moving backward, the controller 200 may send a control signal to produce auxiliary torque necessary to move the wearer's left leg forward while supporting the right leg.

The mechanism unit 100 is a device for assisting the wearer in walking, including components, such as joints and motors for walking motions, actuators like fluid power cylinders, and belts for combining with legs. The mechanism unit 100 may assist the wearer in walking by means of the joints and actuators.

Although not shown in FIGS. 2 and 3, the mechanism unit 100 may include the waist-wear unit 101, the supporting unit 102, the joint unit 103, the fastening unit 104, and the shoe unit 105, as described above, however, example embodiments are not limited thereto. These components were described above and thus the description of them will be omitted herein.

Further, the mechanism unit 100 may include the driving unit 110 as shown in FIGS. 2 and 3. The driving unit 110 may be configured to deliver driving power to the joint unit 103 for rotation. There may be multiple driving units 110 corresponding to the number of the joint units 103, but example embodiments are not limited thereto.

Furthermore, although not shown in FIGS. 2 and 3, in some example embodiments the memory may also include instructions that configure the processor as a mode change unit (not shown).

The mode change unit may be configured to select walking mode, posture mode, walking speed mode, etc. Specifically, the mode change unit may include a walking mode change unit for selecting flat ground walking, rough ground walking, and stair walking; a posture mode change unit for selecting sitting posture, standing posture, and posture-on-slope; a walking speed change unit for selecting fast walking speed, slow walking speed, and normal walking speed, but is not limited thereto.

Further, in some example embodiments the wearable robot may measure electric signals from the wearer's skull with an electroencephalogram (EEG) measurement apparatus which is a device for existing Brain Computer Interface (BCI), extract walking related electric signals from the measurement, calculate an average frequency of the extracted signals, and estimate a current walking speed of the wearer based on the average frequency. Accordingly, without installing a separate device for measuring walking speed in the mechanism unit, the wearer's walking speed may be more conveniently estimated.

A method for controlling the wearable robot will now be described.

FIG. 9 is a flowchart of a method for controlling a wearable robot, according to some example embodiments.

Referring to FIG. 9, in operation S910, the detection unit 300 may detect an arm motion of the wearer. The arm motion of the wearer may refer to, specifically, a direction of an arm motion, i.e., the wearer's arm moving forward or backward.

The detection unit 300 may have sensors equipped on one or more sides of the wearer's body to detect the arms moving forward or backward. For example, the detection unit 300 may have sensors equipped on one side of the wearer's body, for example, the detection unit 300 may include the first sensor 310 arranged near the front of the body and the second sensor 320 arranged near the back of the body, but the present disclosure is not limited thereto. Furthermore, if the detection unit 300 is equipped on both sides of the wearer's body, the first sensor 310 and second sensor 320 may be arranged on either side of the body.

In the case the detection unit 300 is equipped on one side of the wearer's body, in operation S910, the first sensor 310 and second sensor 320 may detect one arm of the wearer moving forward or backward. In the case the detection unit 300 is equipped on both sides of the wearer's body, in operation S910, the first sensor 310 and second sensor 320 may detect both arms of the wearer moving forward or backward.

The first and second sensors 310 and 320 may each include at least one of proximity sensors, hall sensors, and range sensors, however example embodiments are not limited thereto. If hall sensors are used as the first and second sensors 310 and 320, magnetic substances that produce hall effects may be attached to the arm of the wearer.

Next, in operation S920, the controller 200 may determine the direction of the arm motion of the wearer based on the signal detected by the detection unit 300. For example, as discussed above, the controller 200 may determine whether the wearer's arm is moving forward or backward. How the controller 200 determines whether the left and right arms moving forward or backward based on a signal detected by the detection unit 300 was discussed above and thus the description will be omitted herein.

In operation S930, the controller 200 may determine a walking intent of the wearer based on the direction of the arm motion of the wearer, generate a control signal to output auxiliary torque corresponding to the determined walking intent, and send the control signal to the mechanism unit 100.

The controller 300 may determine whether the respective arms of the wearer are moving forward or backward based on the signal detected by the detection unit 200, and control the mechanism unit 100 to produce auxiliary torque necessary to support one leg opposite of an arm moving backward while moving forward the other leg opposite of the other arm moving forward.

For example, if the controller 200 determines that the wearer's left arm is moving forward and the right arm is moving backward, the controller 200 may send a control signal to produce auxiliary torque necessary to move the wearer's right leg forward while supporting the left leg; and otherwise, if the controller 200 determine that the wearer's right arm is moving forward while the left arm is moving backward, the controller 200 may send a control signal to produce auxiliary torque necessary to move the wearer's left leg forward while supporting the right leg.

Example embodiments have thus far been described. Some of the components of the wearable robot may be implemented in modules. The term 'module' may refer to a software module, a Field Programmable Gate Array (FPGA), or a hardware component such as an Application Specific Integrated Circuit (ASIC) for serving a function. However, the module is not limited to software or hardware. The module may be configured to be stored in an addressable storage medium, or to execute one or more processors.

For example, the modules may include components, such as software components, object-oriented software components, class components and task components, processes, functions, attributes, procedures, subroutines, segments of program codes, drivers, firmware, microcodes, circuits, data, databases, data structures, tables, arrays, and variables. Functions served by components and modules may be combined into a less number of components and modules, or further divided into a more number of components and modules. Furthermore, the components and modules may execute one or more processors, such as Central Processing Units (CPUs) within a device.

Some example embodiments of the present disclosure may be implemented by media including computer-readable codes/instructions, such as computer-readable media for controlling at least one processing element. The media may enable storage and/or transmission of the computer-readable codes. The computer-readable codes may be recorded on a media and may be transmitted over the Internet, the media including e.g., Read Only Memories (ROMs), Random Access Memories (RAMs), Compact Disc (CD)-ROMs, magnetic tapes, floppy discs, optical recording media, carrier waves for data transmission over the Internet, etc. The media may also be non-temporary computer-readable media. The media may also be distributed networks, in which case the computer-readable codes may be stored, transmitted, and executed in a distributed way. Furthermore, as an example, the processing element may include a processor or computer processor and be distributed and/or included within a single device.

Several example embodiments have been described, but a person of ordinary skill in the art will understand and appreciate that various modifications can be made without departing the scope of the example embodiments. Thus, it will be apparent to those ordinary skilled in the art that the disclosure is not limited to the example embodiments described, which have been provided only for illustrative purposes.

What is claimed is:

1. A wearable robot comprising:

a walking assistance device configured to assist legs of a wearer of the wearable robot with performing a walking motion, the legs of the wearer including a left leg and a right leg;

a detector configured to detect movement of one or more of arms of the wearer, the arms of the wearer including a left arm and a right arm; and a controller configured to, determine which of the arms is a forward moving arm based on the detected movement, determine which one of the legs of the wearer is a forward moving leg based on which one of the arms is the forward moving arm, and instruct the walking assistance device to transmit auxiliary torque to the forward moving leg.

2. The wearable robot of claim 1, wherein the detector is on a side of a body of the wearer.

3. The wearable robot of claim 2, wherein the detector comprises:

a first sensor near the front of the body of the wearer; and a second sensor near the back of the body of the wearer.

4. The wearable robot of claim 3, wherein if the detector is equipped on a left side of the body of the wearer, the controller is configured to, determine that the left arm of the wearer is the forward moving arm, if a signal is detected by the first sensor.

5. The wearable robot of claim 4, wherein the controller is configured to instruct the walking assistance device to transmit the auxiliary torque to move the right leg of the wearer forward while supporting the left leg of the wearer, if the controller determines that the left arm is the forward moving arm.

6. The wearable robot of claim 4, wherein the controller is configured to, determine that the left arm is moving backward, if a signal is detected by the second sensor on the left side of the body of the wearer, indirectly determine that the right arm is the forward moving arm, if the controller determines that the left arm is moving backward, and instruct the walking assistance device to transmit the auxiliary torque to move the left leg of the wearer forward while supporting the right leg of the wearer, if the controller determines that the left arm is moving backward.

7. The wearable robot of claim 3, wherein the first sensor and the second sensor comprise:

at least one of proximity sensors, hall sensors, and range sensors.

8. The wearable robot of claim 7, wherein the walking assistance device includes a magnetic substance installed on the wearer's arm to produce hall effects detectable by the hall sensors.

9. The wearable robot of claim 1, wherein the detector comprises:

a first detector arranged on a first side of the wearer; and a second detector arranged on a second side of the wearer.

10. The wearable robot of claim 9, wherein the first detector includes a first sensor configured to detect a motion of a first one of the arms of the wearer, and the second detector includes a second sensor configured to detect a motion of a second one of the arms of the wearer.

11. The wearable robot of claim 10, wherein the first sensor and the second sensor are arranged symmetrically on each side of the wearer.

12. The wearable robot of claim 10, wherein the first sensor and the second sensor are arranged diagonally on each side of the wearer.

13. A method for controlling a wearable robot, the method comprising:

detecting movement of one or more of arms of a wearer of the wearable robot, the arms of the wearer including a left arm and a right arm;

determining which of the arms is a forward moving arm based on the detected movement;

determining a forward moving leg from among legs of the wearer based on which one of the arms is the forward moving arm; and transmitting auxiliary torque to the forward moving leg.

14. The method of claim 13, wherein the detecting movement is performed by a detector, the detector being on a body of the wearer.

15. The method of claim 14, wherein determining a moving direction comprises:

directly detecting that one of the arms is the forward moving arm or indirectly detecting that one of the arms is the forward moving arm based on detecting that one of the arms is a backward moving arm.

16. The method of claim 15, wherein the determining the forward moving leg comprises:

determining that one of the legs on an opposite side of the body from a first one of the arms is the forward moving leg, if the first one of the arms is moving forward.

17. The method of claim 15, wherein the determining the forward moving leg comprises:

determining that one of the legs on a same side of the body from a first one of the arms is the forward moving leg, if the first one of the arms is moving backward.

* * * * *